US008763310B2

(12) United States Patent
Dehart, Sr.

(10) Patent No.: US 8,763,310 B2
(45) Date of Patent: Jul. 1, 2014

(54) INSIDE CORNER GUTTER PIECE

(71) Applicant: Jimmy J. Dehart, Sr., Landenberg, PA (US)

(72) Inventor: Jimmy J. Dehart, Sr., Landenberg, PA (US)

( * ) Notice: Subject to any disclaimer, the term of this patent is extended or adjusted under 35 U.S.C. 154(b) by 0 days.

(21) Appl. No.: 13/760,365

(22) Filed: Feb. 6, 2013

(65) Prior Publication Data

US 2014/0047779 A1 Feb. 20, 2014

Related U.S. Application Data

(63) Continuation-in-part of application No. 13/199,882, filed on Sep. 12, 2011, now abandoned.

(51) Int. Cl.
*E04D 13/00* (2006.01)

(52) U.S. Cl.
USPC ..... 52/11; 52/12; 52/13; 52/14; 52/15

(58) Field of Classification Search
USPC ..... 52/11–16; 248/48.1, 48.2
See application file for complete search history.

(56) References Cited

U.S. PATENT DOCUMENTS

| | | | | | |
|---|---|---|---|---|---|
| 2,120,395 | A * | 6/1938 | Dean | 210/474 |
| 2,537,243 | A * | 1/1951 | Swartz | 52/12 |
| 2,899,916 | A * | 8/1959 | Ertman | 52/13 |
| 4,632,342 | A * | 12/1986 | Skinner | 248/48.2 |
| 6,085,466 | A * | 7/2000 | Martin et al. | 52/13 |
| 6,751,910 | B2 * | 6/2004 | Richardson | 52/11 |
| 6,883,760 | B2 * | 4/2005 | Seise, Jr. | 248/48.1 |
| 7,076,921 | B2 * | 7/2006 | Spradlin | 52/11 |
| 7,765,743 | B2 * | 8/2010 | Guilford | 52/12 |
| 7,987,634 | B2 * | 8/2011 | Bailey et al. | 52/12 |
| D651,697 | S * | 1/2012 | Dehart, Sr. | D23/267 |
| 2001/0017008 | A1 * | 8/2001 | Kuhns | 52/11 |
| 2001/0032418 | A1 * | 10/2001 | Richardson | 52/11 |
| 2002/0124476 | A1 * | 9/2002 | Iannelli | 52/11 |
| 2002/0152691 | A1 * | 10/2002 | Wade | 52/11 |
| 2003/0115807 | A1 * | 6/2003 | Richardson | 52/11 |
| 2005/0115160 | A1 * | 6/2005 | Brochu | 52/11 |
| 2006/0225368 | A1 * | 10/2006 | Roe | 52/12 |

* cited by examiner

*Primary Examiner* — Mark Wendell
(74) *Attorney, Agent, or Firm* — John R. Benefiel

(57) ABSTRACT

An inside corner gutter piece for a roof gutter system having an angled outer wall of a center segment extending at a 45 degree angle to outer walls of two straight end segments, the outer wall of the center segment acting as a flow diverter for directing rain runoff from a roof valley into connected straight gutter sections, with a top and down turned edge acting to block a rainwater stream from flowing up and out of the outer wall of the inside corner gutter piece.

2 Claims, 9 Drawing Sheets

INSIDE CORNER GUTTER PIECE

CROSS REFERENCE TO RELATED APPLICATIONS

This application is a continuation in part of U.S. patent application Ser. No. 13/199,882 filed on Sep. 12, 2011, which is a continuation in part of U.S. patent application Ser. No. 12/696,356 filed on Jan. 29, 2010, which claims the benefit of U.S. provisional application No. 61/437,774 filed on Jan. 31, 2011.

BACKGROUND OF THE INVENTION

This invention concerns rain gutter systems mounted along the eaves of a roof to collect rainwater draining from the roof and directing it to downspouts through which it flows down to the ground to a point at which runoff or collection occurs.

A particular gutter problem exists at inside corners formed at valleys on the roof by the intersection of roof sections facing different directions. The roof valleys collect rainwater runoff flow from both roof sections such that a heavier flow of rainwater occurs down the valley.

An inside corner piece is often employed in the gutter system the inside corner piece located at the bottom of such a valley. The greater volume and velocity of the flow down the valley often results in overflow out of the inside corner position of the gutter system.

Efforts to avoid such overflows have included placing upright baffle pieces across the corner of a cover to deflect the flow back into the gutter system. A heavy rain will sometimes result in overflows notwithstanding the presence of the baffles, such that they are not completely effective.

Another approach is to put a horizontal diverter baffle on top of a corner screen extending across the inside corner as described in U.S. Pat. No. 7,765,743, but the velocity of water flow in a downpour onto the diverter can deflect water flow off the diverter and onto the ground.

Another approach is to provide a downspout at the inside corner to collect and immediately drain away the flow as described in U.S. published application U.S./2002/0152691; U.S./2001/0032418 and U.S./2003/0115807, but this approach requires an extra downspout at the corner and does not totally prevent an over splashes at the inside corner.

U.S./2002/0124476 describes a corner gutter cover, at an inside corner formed with upright ridges, but ridges can deflect water flow off the cover such that it is not entirely contained by the gutter system.

U.S. Pat. No. 2,120,395 describes a covered gutter system which employs a 45° extending wall at the corner, to increase the gutter capacity at the corner but again the presence of the cover may cause deflection of the water flow off the cover and out of the gutter system.

A covered inside corner is also described in U.S. Pat. No. 2,537,243 which is elevated and covered. This shape traps debris and cause damming of flow to occur.

Another version described therein has a 45° outer wall at an inside corner valley. However, that gutter has a rounded shape and low outer wall which can allow the flow to ride up and over the low outer wall of the piece to escape the gutter system.

It is an object of the present invention to provide an inside corner piece for a roof gutter system which minimizes the overflow from the gutter of rainwater running down roof valleys without requiring the expense of an extra downspout and effectively prevents overflows while being easily incorporated into conventional gutter systems.

SUMMARY OF THE INVENTION

The above object is achieved by an inside corner gutter installed below a roof valley piece which is formed to connect with adjacent straight gutter sections converging onto the piece at right angles to each other, with an outer wall extending at 45° across the inside corner with the outer wall comprising an upright surface presented across the inside corner. The inside corner piece has a lip along the top of the outer wall which includes a top extending back towards the roof valley and a downwardly extending terminal edge. The outer wall and lip formed thereon blocks and diverts rainwater runoff flow back which has descended down a roof valley into the inside corner gutter piece and horizontally into the connected straight gutter sections.

At the same time the greater distance of the inside corner gutter piece results in better blocking of the descending rainwater flow since the water stream from the roof valley descends further when crossing that greater distance before encountering the outer wall which is therefore better able to block that flow. The outer wall top lip also matches the shape of the conventionally shaped straight gutter sections to be able to be received in the ends of the inside corner gutter piece.

DETAILED DESCRIPTION

Figure 1:
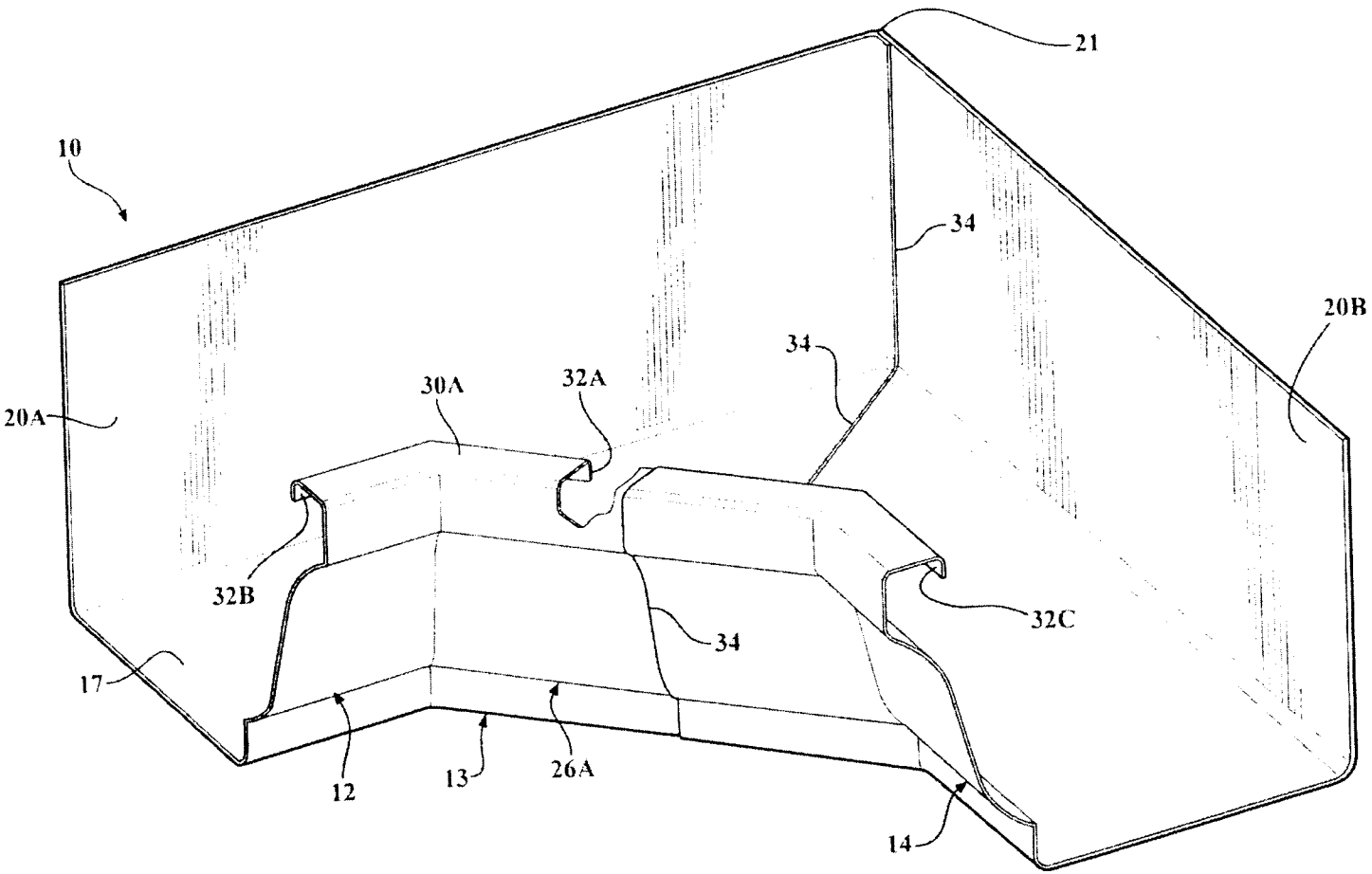
FIG. 1 is a pictorial view of an inside corner gutter piece according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, FIGS. 1-4 shows an inside corner gutter piece 10 according to the invention. A pair of straight end segments 12, 14 extend at right angles to each other are each shaped in section to be able to receive conventional straight gutter sections 16, 18 of the gutter system, which could be made slightly larger so as to slidably receive the same. The overlapped ends would be riveted and/or caulked together in conventional fashion.

An upright rear wall 20 of the gutter piece 10 is flat and vertical and has two sections 20A, 20B meeting at right angle corner 21, each section 20A, 20B normally installed behind the lower leg of a respective length of drip edge 22 usually installed beneath the lower course of roof shingles 24 when the roof is installed.

The two straight end segments 12, 14 are connected by an angled center segment 13. According to the present invention, an outer wall portion 26A of the center segment 13 extends at a 45 degree angle to the outer wall portions 26B, 26C of the end straight segments 12, 14 integral therewith.

A bottom wall 17 extends out from the rear wall 20 connecting together the outer walls 26A, 26B, 26C and the rear wall 20.

This locates the outer wall 26A directly aligned and in front of the roof valley 28 and perpendicular thereto but at level below the valley 28 when the gutter piece 10 is installed.

This creates a blocking and containment of rainwater off-flow received from the roof valley 28 which is superior to the prior art diverters since it is bigger than conventional diverters, and further away and lower with respect to the bottom of the roof valley 28.

The rainwater flow from the valley 28 plunges after leaving the valley 28 so that it is lower when reaching the inside of the angled outer wall 26A and less likely to surge over the top of outer wall 26A.

Figure 4:
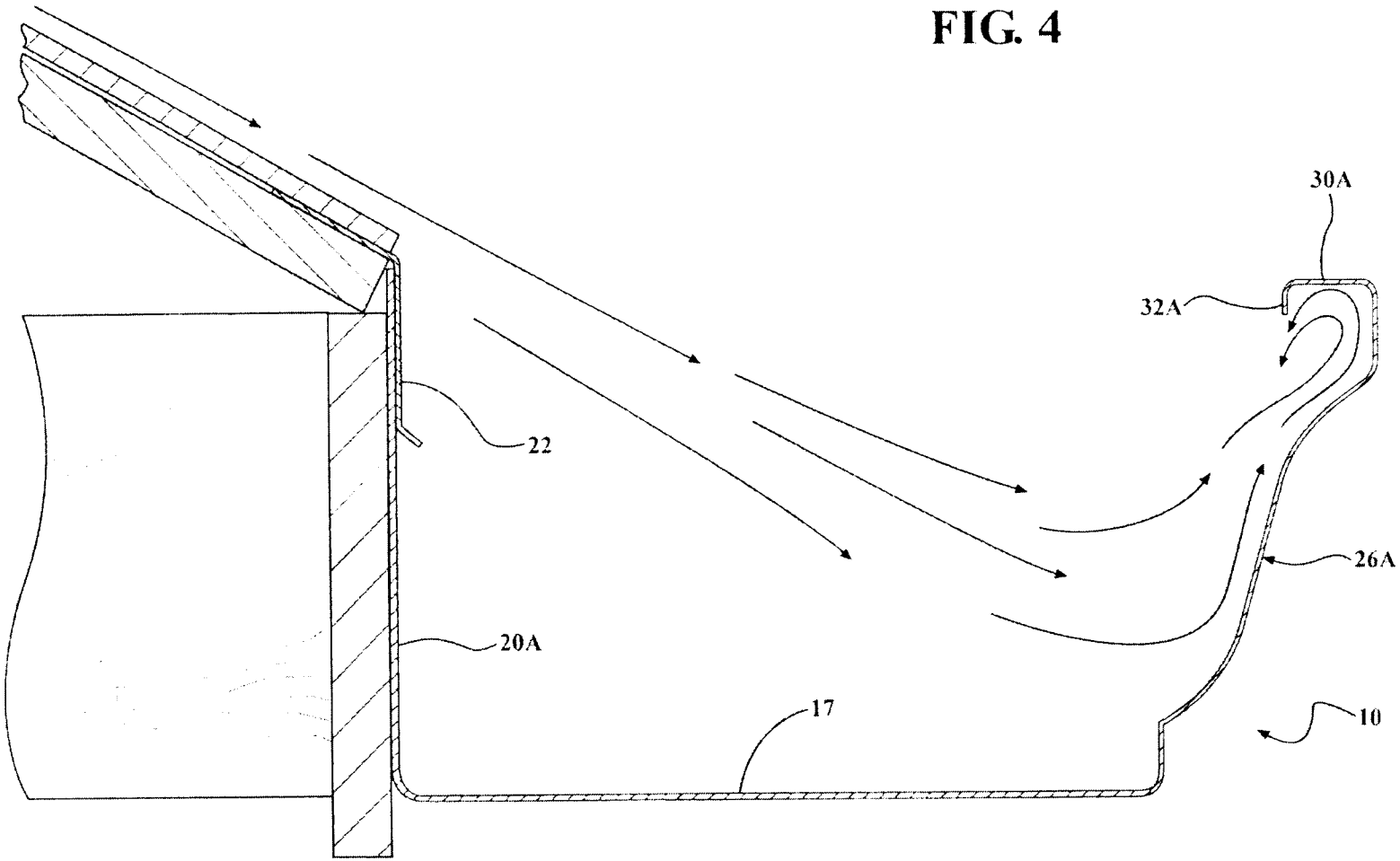
FIG. 4 is a vertical section view taken through the middle of the inside corner gutter piece shown in FIGS. 1-3.

In addition, the upper part of the outer wall angled portion 26A is formed with a lip comprised of a horizontal top segment 30A directed towards a corner formed by the two rear wall sections and a downward extending terminal edge 32A (FIG. 4).

Thus, any rainwater off-flow stream climbing up the inside of the outer wall 26A is blocked by the top segment 30A and redirected back down and diverted to the right and left into the straight segments 12, 14.

A similarly shaped lip is formed on the outer wall 26B, 26C straight segments 12 to further the channeling to the adjacent gutter sections 16, 18.

Figure 2:
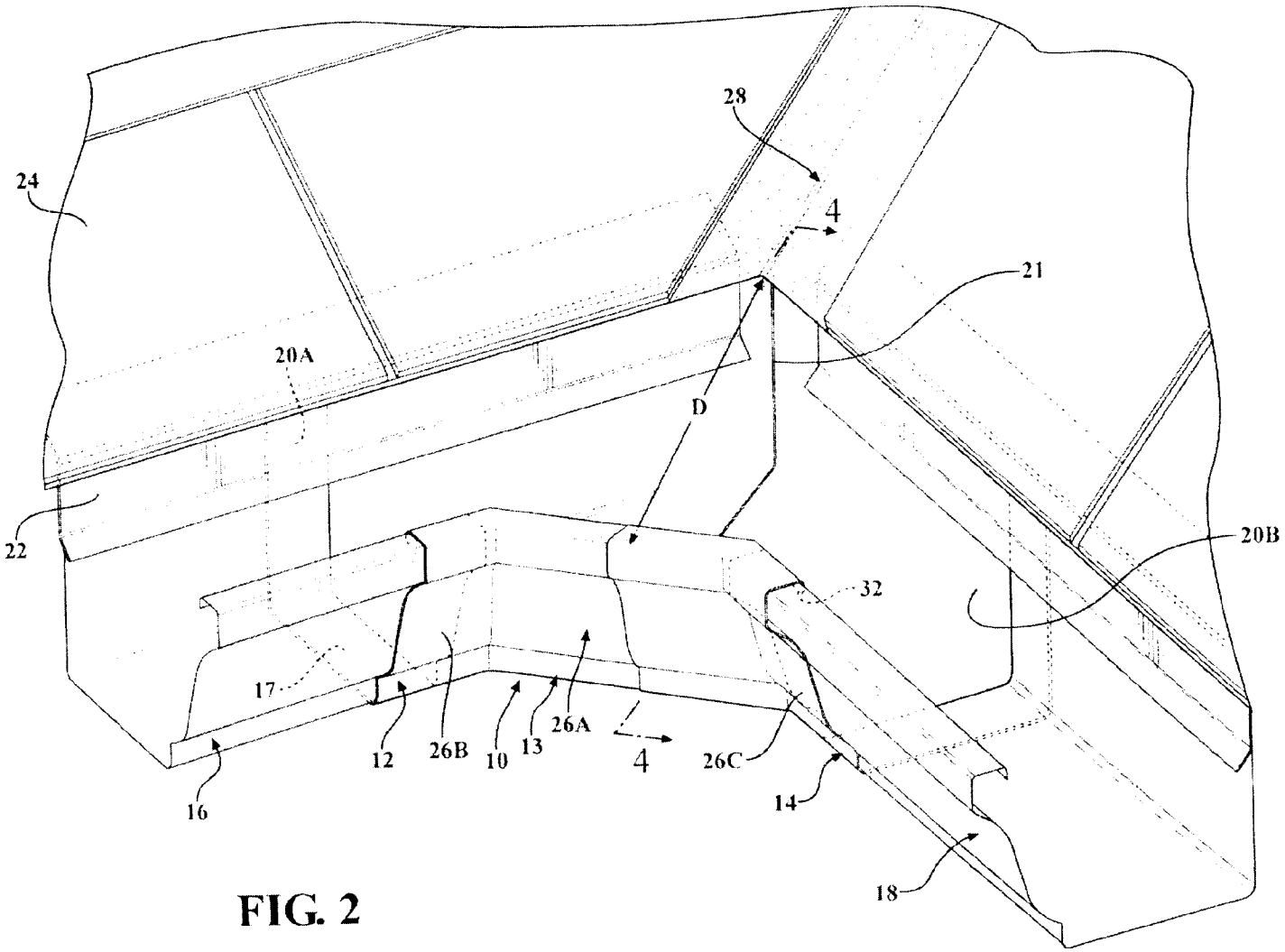
FIG. 2 is a pictorial view of the inside corner gutter piece shown in FIG. 1, installed on a roof gutter system with fragmentary portions of the roof and connected gutter straight sections shown.
Figure 3:
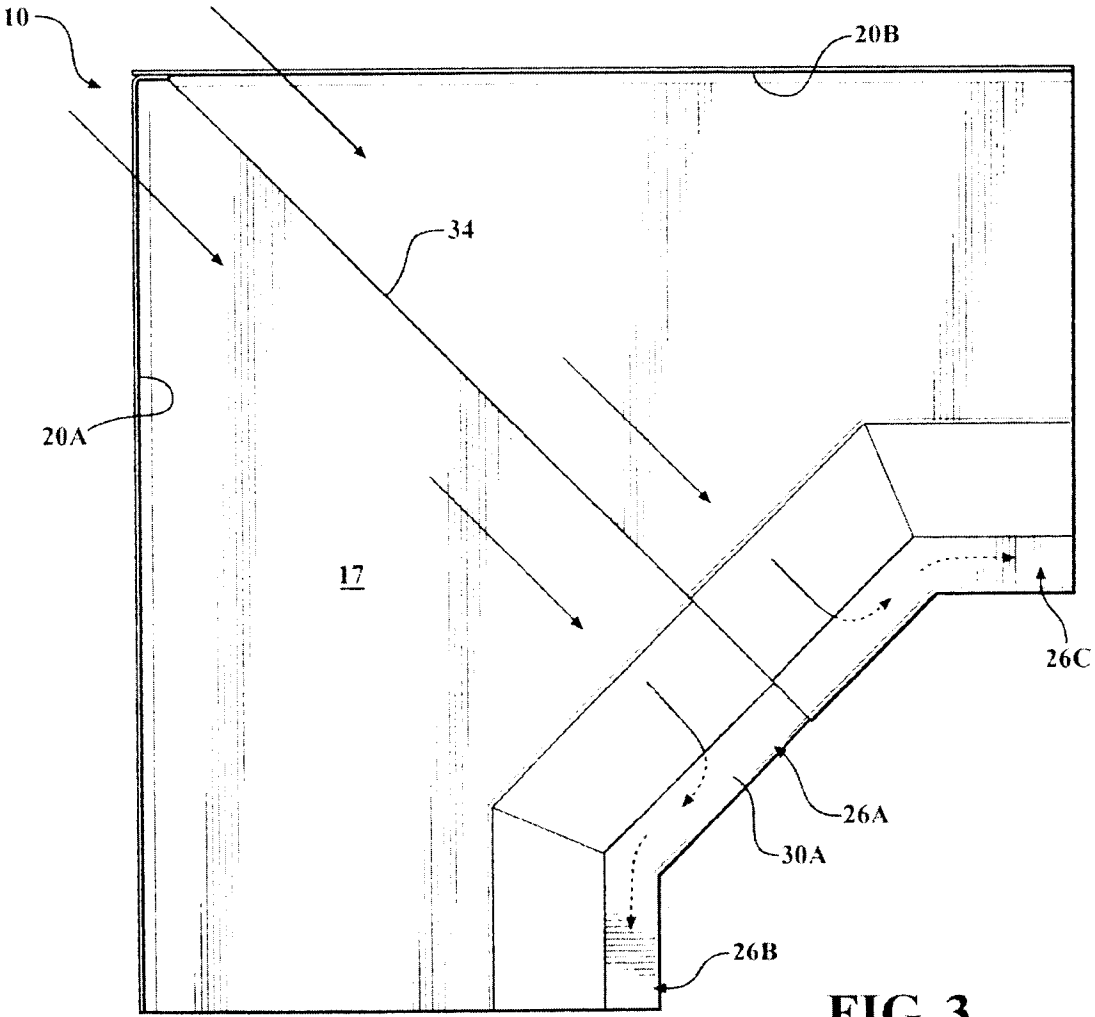
FIG. 3 is a plan view of the inside corner gutter piece shown in FIGS. 1 and 2.

The shape of the outer walls 26B, 26C is matched to that of conventional gutter sections such that the straight ends 12, 14 receive the ends of adjacent straight gutter sections 16, 18 as shown in FIG. 2.

The inside miter piece 10 can be made in two parts joined together as with a miter seam 34 extending through the middle of the piece 10, by conventional gutter manufacturing techniques.

Figure 5:
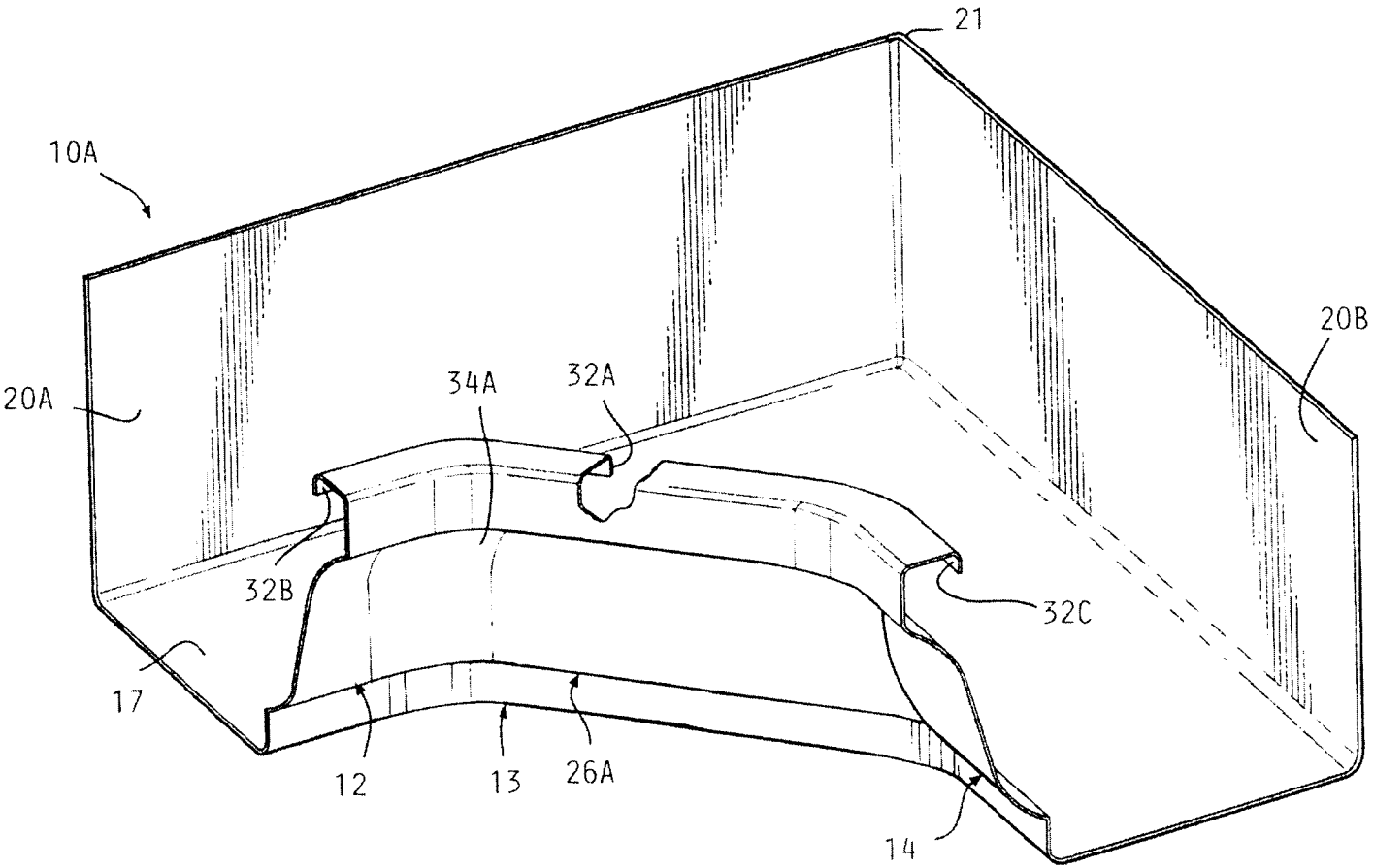
FIG. 5 is a pictorial view of a second embodiment of an inside corner miter gutter piece according to the invention.
Figure 6:
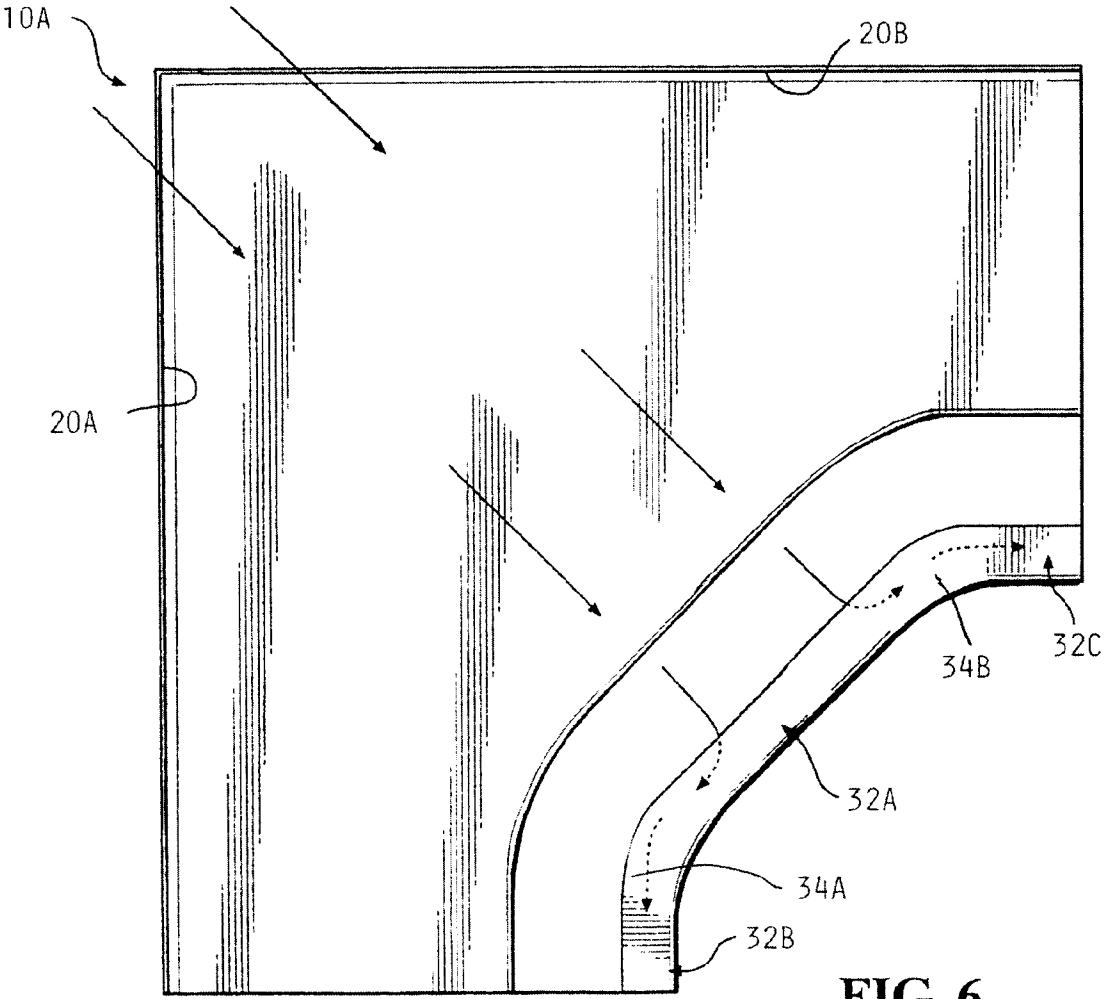
FIG. 6 is a plan view of the embodiment shown in FIG. 5.
Figure 7:
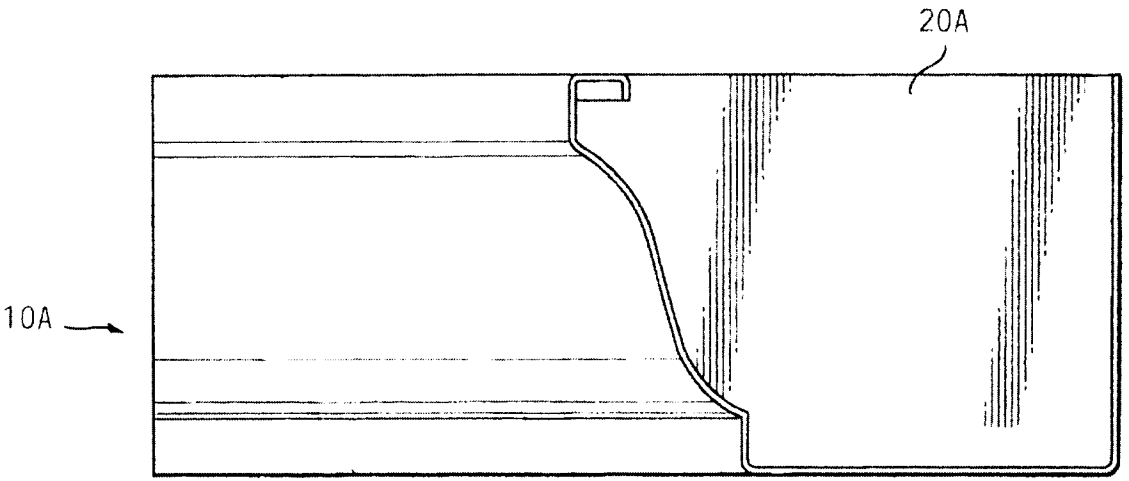
FIG. 7 is an end view of the embodiment shown in FIGS. 5 and 6.
Figure 8:
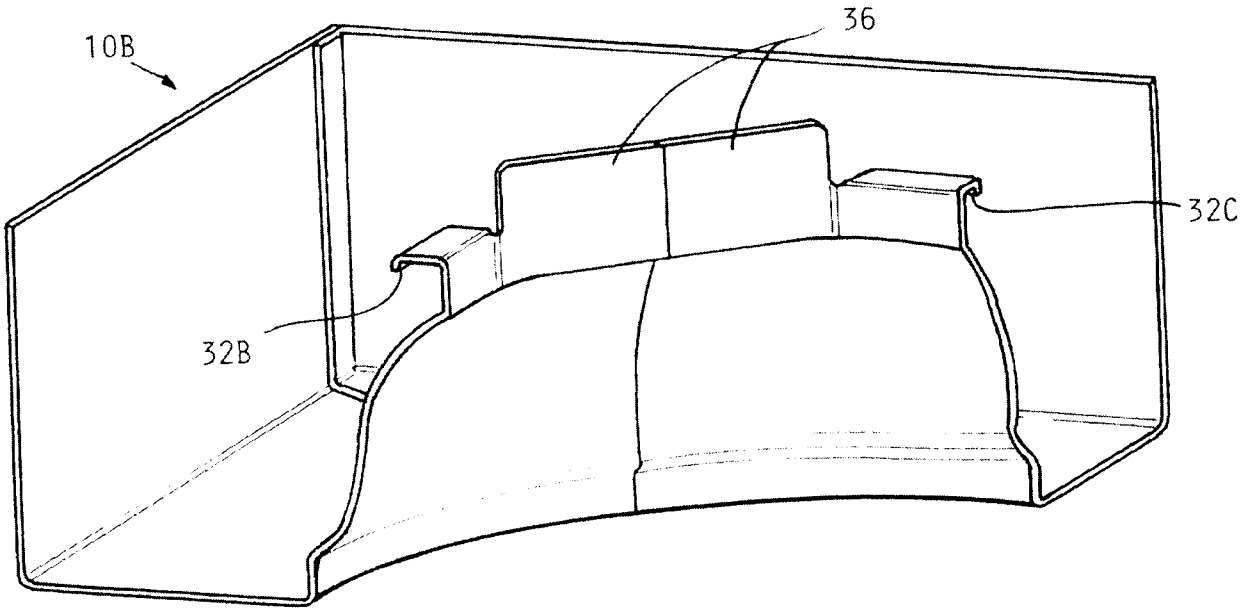
FIG. 8 is a pictorial view of the third embodiment of an inside miter corner piece of the invention.
Figure 9:
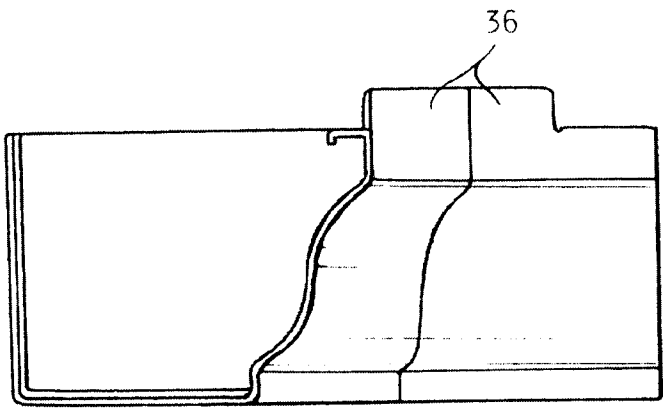
FIG. 9 is an end view of the embodiment shown in FIG. 8.
Figure 10:
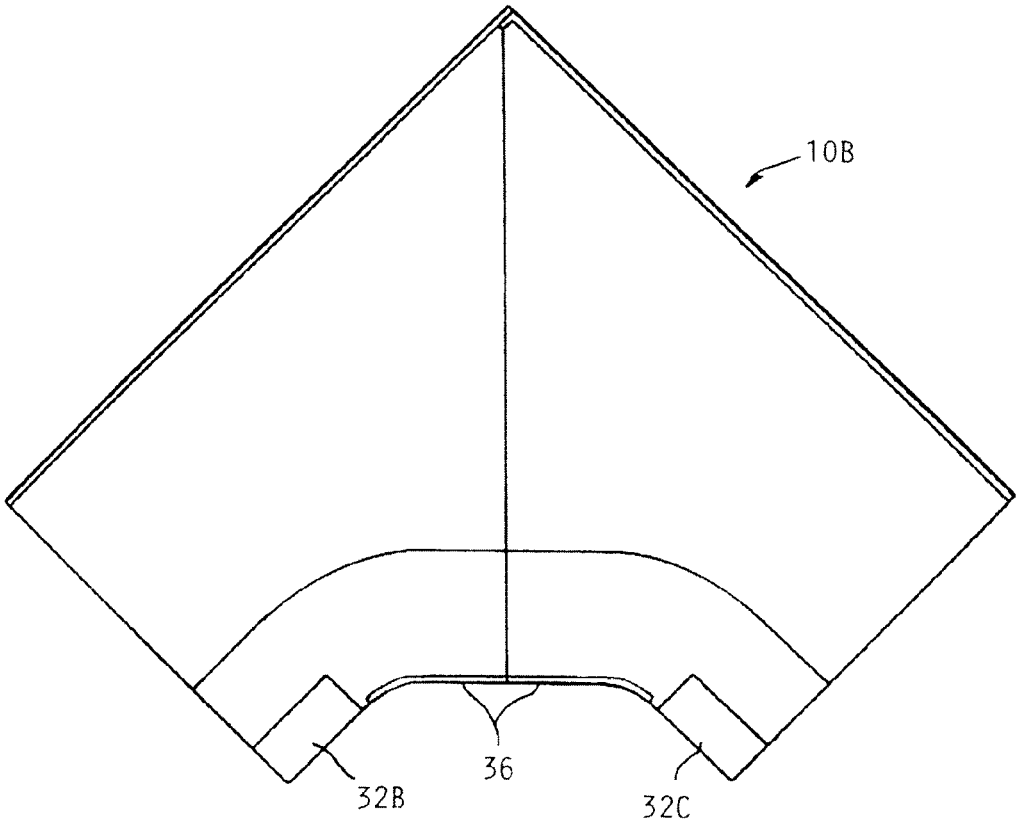
FIG. 10 is a plan view of the embodiment shown in FIGS. 8 and 9.
Figure 11:
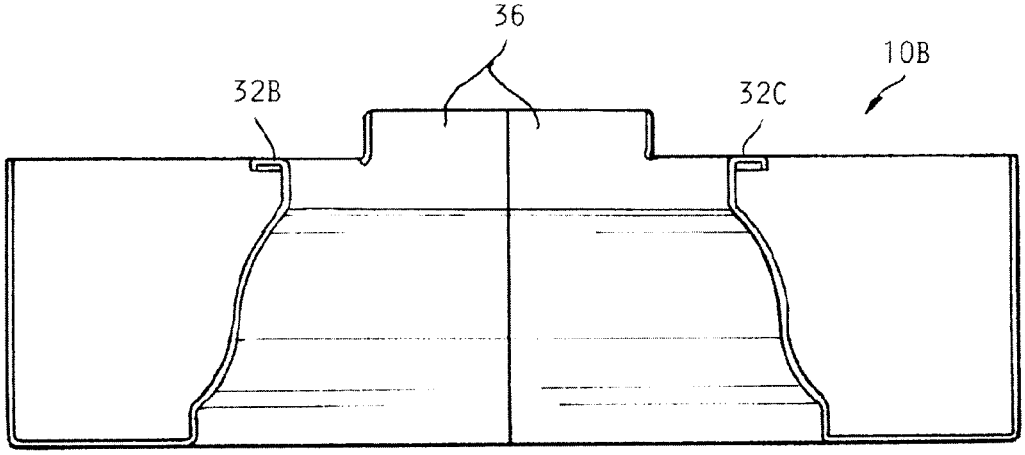
FIG. 11 is a front elevational view of the embodiment shown in FIGS. 8-10.

FIGS. 5-7 show another embodiment of the inside miter piece 10A in which formed curved transitions 34A, 34B are provided.

FIGS. 8-11 show another two part embodiment 10B in which upright tabs 36 are cut from the center lip 32A and left upright.

The invention claimed is:

1. An inside corner gutter piece for a roof eave gutter system comprising:

a pair of corner gutter piece sections joined together, said sections each including a respective straight end segment, each configured to slidably receive an end of a conventional adjacent gutter system straight section and extending at right angles to each other, each end segment having an outer wall, a bottom wall and an inner wall connected by said bottom wall to said outer wall, each of said inner walls extending past said end segments to meet and be joined together form a right angle back corner of said corner gutter piece;

said corner piece sections each further including a separate angled center segment, each center segment having an outer wall integral with an outer wall of a respective end segment, said outer wall of each center segment extending at an angle of about 45 degrees to said outer wall of an associated end segment, said center segments each having a bottom wall integral with an associated one of said end segments extending back to a respective inner wall; each of said center segments outer wall formed with a top extending inwardly back toward said inner walls and also formed with a terminal inner edge extending downward from the inside of said top to create a channel capturing any rainwater flow surge climbing to the top of said outer walls of said center segments;

said bottom wall of said center segments mitered and joined together and said center segments outer walls having abutting ends joined together to form said inside corner gutter piece.

2. The inside corner gutter piece according to claim 1 wherein said outer wall of each of said end segments are also formed with an inwardly extending top and downwardly extending edge integral with said top.

* * * * *